United States Patent [19]

Hoffman

[11] 4,063,427

[45] Dec. 20, 1977

[54] SEAL ARRANGEMENT AND FLOW CONTROL MEANS THEREFOR

[75] Inventor: Erwin E. Hoffman, Houston, Tex.

[73] Assignee: Lynes, Inc., Houston, Tex.

[21] Appl. No.: 603,137

[22] Filed: Aug. 4, 1975

[51] Int. Cl.[2] ..... E02D 5/00

[52] U.S. Cl. ..... 61/100; 166/116; 166/187

[58] Field of Search ..... 61/46, 46.5, 53, 53.5, 61/54, 86, 98, 100; 166/116, 187; 285/96, 106, 109

[56] References Cited

U.S. PATENT DOCUMENTS

| | | | |
|---|---|---|---|
| 3,457,728 | 7/1969 | Pogonowski | 61/46.5 |
| 3,533,241 | 10/1970 | Bowerman et al. | 61/46.5 |
| 3,564,856 | 2/1971 | Blount et al. | 61/46 |
| 3,570,259 | 3/1971 | Thaxton | 61/53.5 |
| 3,702,537 | 11/1972 | Landers | 61/46.5 |
| 3,919,850 | 11/1975 | Coone et al. | 61/46.5 |

*Primary Examiner*—Paul R. Gilliam
*Assistant Examiner*—David H. Corbin
*Attorney, Agent, or Firm*—William C. Norvell, Jr.

[57] ABSTRACT

An inflatable reinforced sealing element for positioning on a jacket to seal off the space between the jacket and a piling in the jacket, with the jacket and piling being associated with the supporting leg of an offshore structure. Control means are provided for controlling the flow of fluid for inflation of the seal means to sealingly engage the piling and seal off the space, to trap the inflating fluid in the seal means and for controlling the flow of grouting material to the space between the jacket after the seal has been effected.

7 Claims, 4 Drawing Figures

SEAL ARRANGEMENT AND FLOW CONTROL MEANS THEREFOR

CROSS REFERENCE TO RELATED APPLICATIONS

The present invention relates to the invention disclosed and claimed in the application of Malcolm G. Coone, which application is assigned to the assignee of this application said copending application bearing Ser. No. 465,851, filed on May 1, 1974, for Structure and Method of Positioning For Use In Water Covered Areas. It also is related to the copending application of Malcolm G. Coone and Erwin E. Hoffman, assigned to the assignee of this application, said application bearing Ser. No. 603,029, filed on Aug. 4, 1975, for Grouting System and Arrangement For Offshore Structure.

SUMMARY OF THE PRESENT INVENTION

An object of the present invention is to provide a reinforced annular inflatable seal for positioning on the jacket associated with a supporting leg of an offshore structure for sealing with a piling driven through the jacket to seal off the space between the jacket and the piling. Control valve means are provided for controlling communication with the inflatable means for supplying inflating fluid thereto, and for thereafter trapping the inflating fluid in the seal means to retain the seal means inflated. The control means also controls communication to the annular space so that suitable grouting material may be provided to the annular space after the seal has been effected.

Another object of the present invention is to provide a control means for an inflatable element secured to the jacket associated with a supporting leg of an offshore structure whereby inflating fluid may be supplied to expand the seal means into sealing engagement with a piling positioned in the jacket, and after the seal means has been inflated, the control means then functions to communicate grouting material to the space between the jacket and piling for filling such space.

Another object of the present invention is to provide a control means for an inflatable element secured to the jacket associated with a supporting leg of an offshore structure whereby inflating fluid may be supplied to expand the seal means into sealing engagement with a piling positioned in the jacket, and after the seal means has been inflated, the control means then functions to communicate grouting material to the space between the jacket and piling for filling such space, the control means is constructed and arranged so that when the inflating pressure of the seal means reaches a predetermined amount, communication is established to the annular space to enable grouting material to flow thereto. When this occurs, the control means then functions so as to trap the inflating fluid within the inflatable element.

Another object of the present invention is to provide a control means for an inflatable element secured to the jacket associated with a supporting leg of an offshore structure whereby inflating fluid may be supplied to expand the seal means into sealing engagement with a piling positioned in the jacket, and after the seal means has been inflated, the control means then functions to communicate grouting material to the space between the jacket and piling for filling such space, the control means is constructed and arranged so that when the inflating pressure of the seal means reaches a predetermined amount, communication is established to the annular space to enable grouting material to flow thereto. When this occurs, the control means then functions so as to trap the inflating fluid within the inflatable element. The control means is also constructed and arranged so as to prevent backflow of grouting material from the space through the control means either during the grouting operation or after completion thereof. This may be employed to urge a compressive force on the grouting material, in some situations, during hardening thereof to effect a compressive force within the hardened grouting material.

Other objects and advantages will become apparent from a consideration of the following description and drawings.

DESCRIPTION OF THE PREFERRED EMBODIMENT

Figure 1:
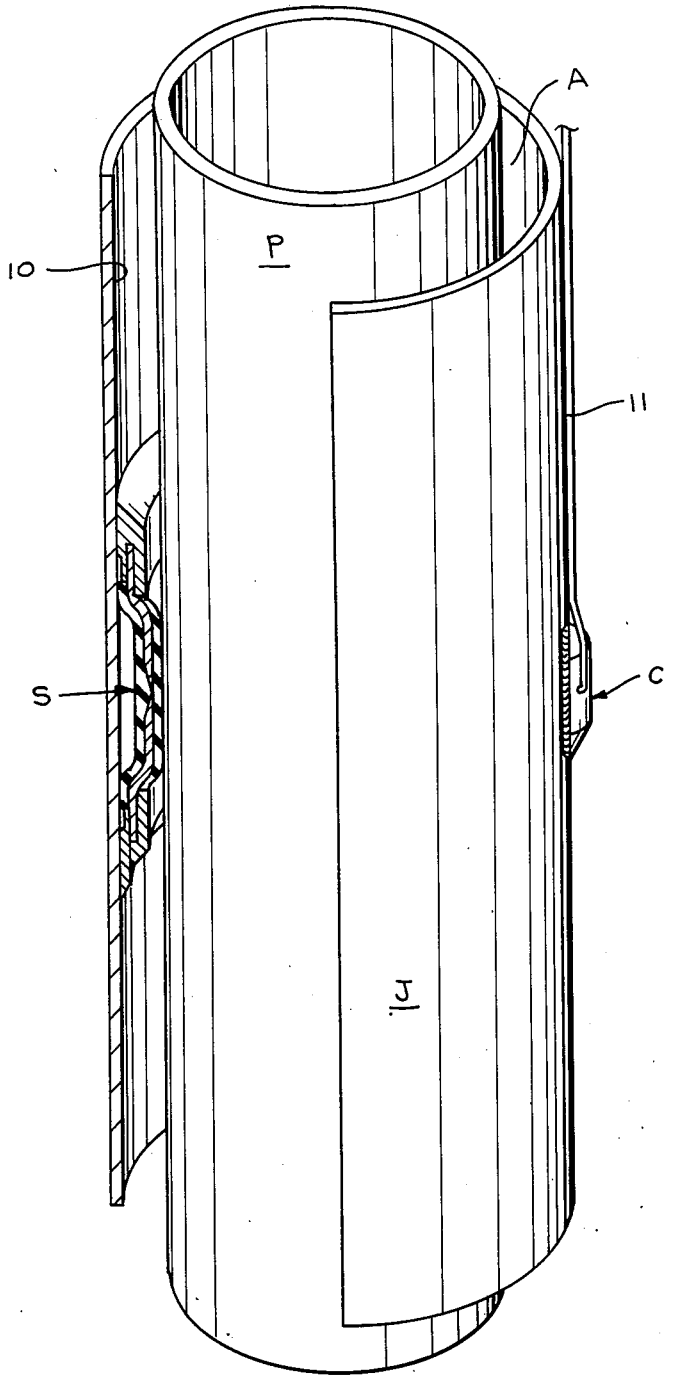
FIG. 1 is a diagrammatic view illustrating the seal of the present invention positioned on a jacket and the control means employed for controlling communication to the seal means and the space between the jacket and the piling positioned therein.

Attention is first directed to FIG. 1 of the drawings wherein a jacket is referred to by the letter J with a piling P positioned therein. The jacket J and piling P are associated with the supporting structure of an offshore drilling or production platform in a manner well known in the art and as described in the above referred to copending applications. As can be seen in the drawings, the jacket J comprises an annular member as does the piling P with the piling P having a smaller diameter than the jacket J to form an annular space A therebetween. After the piling has been positioned in the jacket, it is desirable to seal off the annular space in one of several manners, as described in the above referred to copending applications and then fill such annular space with any suitable form of grouting material which will form a permanent set.

Inflatable seal means referred to generally by the letter S is shown as being positioned on the interior 10 of the jacket and secured thereto at each end in a desired position longitudinally of such jacket. Suitable control means referred to by the letter C is also secured to the jacket and a conduit 11 extends from a suitable working area either on the platform with which the present arrangement is employed or on a vessel so that fluid medium may be supplied therethrough and to the conduit means for communication with the inflatable seal S and the annular space A as will be described in greater detail hereinafter.

Figure 3:
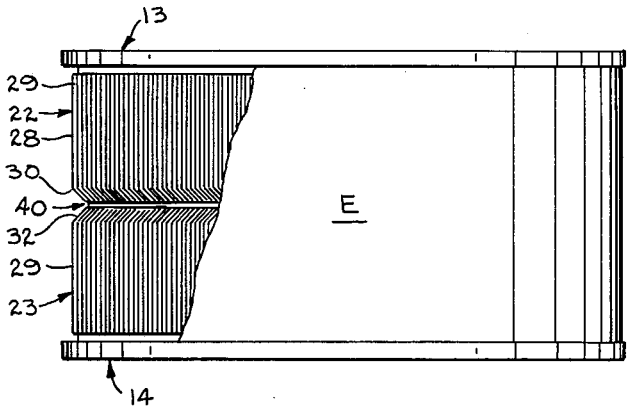
FIG. 3 is an elevational view illustrating the reinforced inflatable element, with a portion of the outer covering removed to better illustrate the arrangement of the reinforcing therein.
Figure 2:
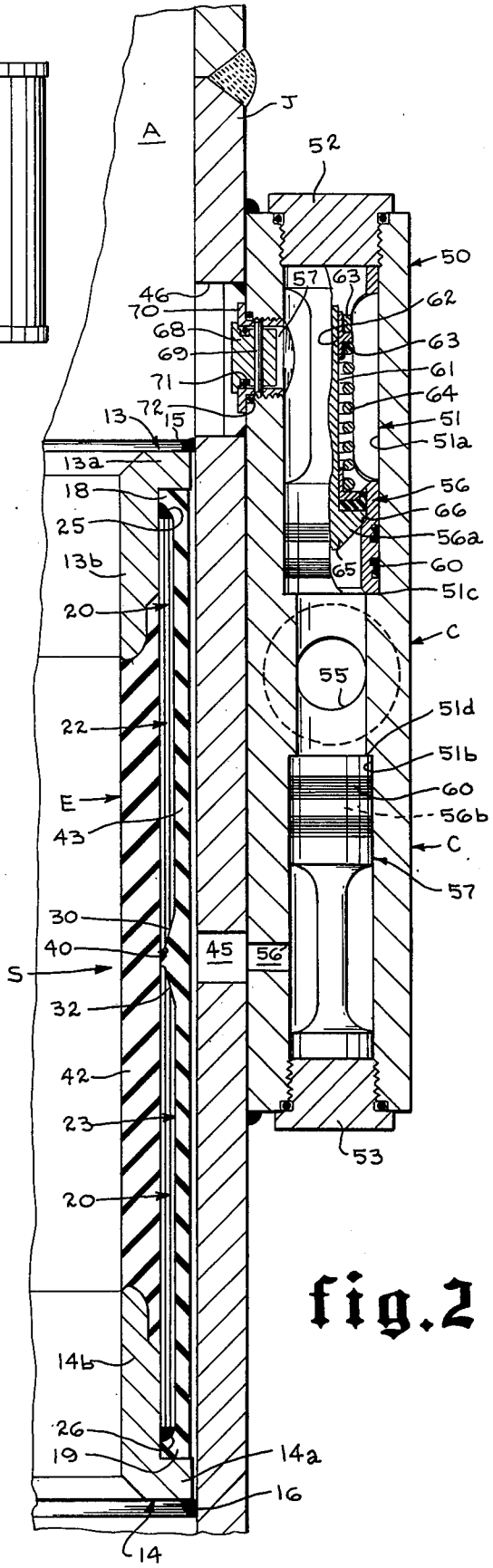
FIG. 2 is an enlarged fragmentary sectional view illustrating in greater detail the arrangement of the reinforced inflatable means and control means on the jacket.

FIG. 2 illustrates a preferred form of the reinforced inflatable seal means in greater detail as well as the control means. A pair of annular members 13 and 14 are secured to the jacket J in longitudinal spaced relation by any suitable means such as welds 15 and 16. The members 13 and 14 each include a portion **13*a* and 14*a* which are secured to the jacket J by means of the welds 15 and 16 respectively and are in turn secured to the annular longer portions 13***b* and 14*b* in any suitable manner such as by the welds as shown so that the members 13*b* and 14 *b* are spaced radially inwardly relative to the interior 10 of the jacket J. This forms recesses 18 and 19 within the members 13 and 14 respectively and the reinforcing referred to generally by the numeral 20 which reinforcing 20 comprises two annular groups 22 and 23 of reinforcing members which are secured at one end as shown at 25 and 26 respectively to the members 13 and 14 by any suitable means such as welds or the like. As shown in greater detail in FIG. 3, the annular groups of reinforcing members 22 and 23 comprise a plurality of strips 28 which extend longitudinally from the members 13 and 14 and overlap circumferentially and longitudinally as illustrated at 29.

Figure 4:
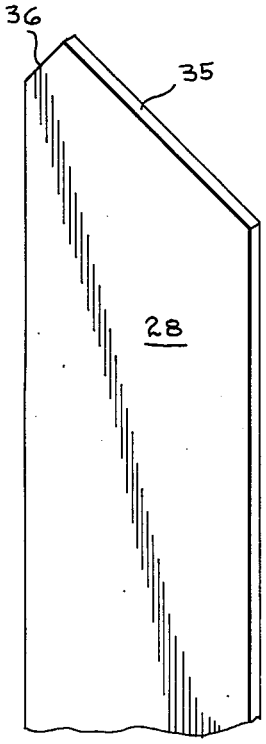
FIG. 4 is an enlargement of one end of the reinforcing strips.

It will be noted that the outermost ends 30 and 32 of the groups of reinforcing members 22 and 23 are tapered as shown at 35 in FIG. 4 to form a generally circumferentially extending groove of general V-shaped configuration 40.

FIG. 4 shows one of the members 28 in enlarged form with the taper 35 at one end thereof, which taper is preferably at a 45° angle, and it will be noted that such taper extends, for purposes of illustration only approximately 1¼ inches and then there is a reverse taper 36 of 45° of approximately ¼ inch where the reinforcing strip 28 is 1½ inches in width.

The members 13*b* and 14*b* may serve as forming mandrels for the forming of the inflatable member so that the reinforcing strips 28 are positioned to overlap the next adjacent strip circumferentially and longitudinally and welded or otherwise secured into position to the members 13*b* and 14*b* respectively.

Thereafter the elastomer body referred to generally by the letter E may be vulcanized or otherwise formed over the reinforcing to provide the seal as illustrated in FIG. 2 of the drawings. It will be noted that the elastomer body E comprises an inner portion 42 as well as a portion 43 adjacent the inner surface 10 of the jacket J.

Prior to positioning the jacket J and the structure with which it is associated in a water covered area, the seal means S as well as the control means C is positioned thereon. The jacket J is provided with a port as shown at 45 for communication with the seal means and a port 46 for communication with the annular space A between the jacket J and the piling P.

The control means C includes a housing 50 of any suitable configuration, which for purposes of illustration is shown as being round. The housing 50 includes a longitudinal bore 51 extending therethrough with the bore being closed off at each end by caps 52 and 53. The bore 51 includes the counter bores 51*a* and 51*b* which form shoulders 51*c* and 51*d* respectively for receiving the valve means housing referred to generally at 56 and 57 respectively.

The housing 50 also includes a first port means 55, a second port means 56 and a third port means 57 each of which communicates with the logitudinal bore 51 as illustrated in FIG. 2 of the drawings.

The valve housings 56 and 57 support spring loaded check valves 56*a* and 56*b* of any suitable form. Suitable seal means 60 seal between the housings 56 and 57 and the counter bores 51*a* and 51*b* respectively and a spring loaded plunger 61 is slidably supported in each of the housings by means of the passage 62 formed in the central support 63 formed in each housing 56 and 57. The central support 63 provides a shoulder 63 for receiving the spring 64 which tends to urge the valve member 65 towards seating position on the seat 66 formed in each of the housings 56 and 57 to thereby maintain the valves in normally closed position.

Thus, communication between the first port 55 and second port 56 is normally prevented as is communication between the first port 55 and third port 57 of control means C.

A conduit 11 as previously noted extends downwardly and is connected into the first port means 55 as shown in FIG. 1 of the drawings. It will be noted that the valve means housings 56 and 57 are of suitable longitudinal extent to abut against the closure plugs 52 and 53 respectively when seated on shoulders 51*c* and 51*d*.

The third port means 57 is normally closed off by a plug 68 which is retained in position in the port means 57 by the shear pin 69. The plug 68 is slidably received within the housing 70 which is threadedly secured in the opening 57 therebeing seal means 71 between the housing 70 and the plug 68 so as to inhibit fluid leakage therebetween. There is also seal means 72 between housing 70 and port 57 as shown in the drawings.

When it is desired to expand the inflatable members to seal off the space A between the jacket J and piling P, inflating fluid of any form may be communicated through the conduit 11 to the first port means 55 of the housing 50. When the pressure of such inflating means overcomes the springs 64, the valve member 65 will move off seat 66 and permit the first port means 55 and second port means 56 to communicate whereby inflating fluid is conducted through the opening 45 in the jacket J to act on the inflatable seal means S and expand it radially outwardly into sealing engagement with the piling P.

As previously noted, the ends of the seal means S are each secured to the annular members 13 and 14 respectively, but the arrangement of the reinforcing 20 enables the elastomer body E to yield, while providing sufficient resistance to bursting or tearing of the elastomer body E during inflation thereof.

When a predetermined inflation pressure is reached, by way of example only, 300 to 500 pounds p.s.i., the pressure acting to inflate the seal means S is also acting on the plug 68 since the spring 64 in the valve 56*a* may be of suitable tension to accommodate flow from the port 55 to communicate with the third port means 57. When the shear strength of the pin 69 has been exceeded it will shear and the plug 68 will be ejected into space A so as to establish communication between the first port means 55 and third port means 57.

If desired, grouting material may be employed as the inflating medium for the seal means S so that when the plug 68 is ejected, this will cause the pressure in conduit 11 to drop whereupon the check valve 56*b* will move to seating position and close off communication therethrough. Since it is a one way acting check valve, this traps the inflating fluid within the annular seal S and retains it inflated. Thereafter, the grouting material may be pumped through the third port means 57 into the annular space A and fill same.

In some circumstances it may be desirable to apply a compressive force to the grouting material as it sets in space A as described and claimed in the above referred to cross referenced patent applications and in this instance when the desired amount of pressure has been applied to the grouting material in annular space A, the pressure may be relieved to permit the valve 56*a* to reseat to trap the grouting material within the annular space and prevent back flow from such annular space to the first port means 55.

The groups of reinforcing members 22 and 23 along with the beveled end arrangement enables the inflatable element to inflate and lessens the tendency of rupture or tearing of the inflatable member by reason of such generally V-shaped groove 40 adjacent the midsection of the seal means S. It will be noted that the ends 30 and 32 of the reinforcing members 28 of each annular group 22 and 23 are slightly spaced as shown in the drawings.

Also as noted in the drawings the valve means 56*a* and 56*b* are in aligned but opposed opening relationship within the bore 51 of the housing 50. It can be appreciated that any suitable form of check valve means may be employed, and those described are for purposes of illustration only.

The foregoing disclosure and description of the invention are illustrative and explanatory thereof, and various changes in the size, shape, and materials as well as in the details of the illustrated construction may be made without departing from the spirit of the invention.

What is claimed is:

1. An arrangement for grouting an offshore structure positioned on the seabed and having at least one tubular jacket in the water and the piling in the jacket having an outside diameter smaller than the inside diameter of the jacket to thereby form a space between the jacket and piling, said arrangement including:

a. expandable seal means for securing to the jacket;
b. control means for controlling communication to said expandable seal means and for controlling communication to the space, said control means comprising spring loaded check valve means arranged in alligned, opposed relation;
c. said control means including means to trap fluid in said expandable seal means;
d. a housing having a longitudinal bore;
e. first and second spring loaded check valve means mounted in the bore in spaced relation to open in opposite directions, said first spring loaded check valve means being operational in expansion of said expandable seal means and said second spring loaded check valve means being operational to thereafter maintain said seal means in expanded position;
f. said housing having first port means for selective fluid communication between the longitudinal bore between said first and second check valve means and the exterior of said housing; and
g. there being second port means in said housing normally closed off from said first port means by said first spring loaded check valve means, the second port means being communicable with the first port means when the pressure in the longitudinal bore overcomes said first spring loaded check valve means.

2. The invention of claim 1 including:

a. therebeing third port means in said housing normally closed off from communicating with the first port means by said second spring loaded check valve means;
b. plug means in the third port means closing off communication between the longitudinal bore and the space; and
c. shear means retaining said plug means in the third port means, said shear means releasing said plug means when the pressure in the longitudinal bore reaches a predetermined amount to communicate the longitudinal bore with the space.

3. The invention of claim 2 wherein said first spring loaded check valve means closes when the third port means communicates the longitudinal bore with the space to trap fluid in said expandable seal means.

4. An arrangement for grouting an offshore structure positioned on the sea bed and having at least one tubular jacket in the water and a piling in the jacket having an outside diameter smaller than the diameter of the jacket to thereby form a space between the jacket and the piling, said arrangement including:

a. expandable seal means for securing to the jacket;
b. means for controlling fluid communication to said expandable seal means and for controlling fluid communication to said space between the jacket and piling;
c. said last named means including means to trap said fluid in said expandable seal means;
d. said control means comprising spring loaded check valve means for controlling communication to said expandable seal and to said space;
e. said spring loaded check valve means being arranged in aligned, opposed relation;
f. said spring loaded check valve means comprising:
   1. a housing having a longitudinal bore;
   2. a first and second spring loaded check valve means mounted in the bore in spaced relation to open in opposite directions;
   3. said housing having first port means for communicating the longitudinal bore between said first and second check valve means with the exterior of said housing means;
   4. therebeing second port means in said housing normally closed off by said first port means by said first spring loaded check valve means, the second port means being communicable with the first port means when the pressure in the longitudinal bore overcomes said first spring loaded check valve means;
   5. therebeing third port means in said housing normally closed off from communicating with the first port means by said second spring loaded check valve means;
   6. plug means in the third port means closing off communication between the longitudinal bore and the space; and
   7. shear means retaining said plug means in the third port means, said shear means releasing said plug means when the pressure in the longitudinal bore reaches a predetermined amount to communicate the longitudinal bore with the space, said first spring loaded check valve means closing when the third port means communicates the longitudinal bore with the space to trap fluid in said expandable seal means.

5. An arrangement for securing an offshore structure positioned on the seabed and having at least one tubular jacket in the water and having a piling in a jacket having an outside diameter smaller than the inside diameter of the jacket to thereby form a space between the jacket and the piling, said arrangement including:

a. expandable seal means for securing to the jacket;
b. spring loaded check valve means arranged in alligned, opposed relation for controlling fluid communication to said expandable seal means and for controlling fluid communication to said space between the jacket and the piling;

c. said spring loaded check valve means including means to trap said fluid in said expandable seal means;

d. a housing having a longitudinal bore;

e. a first and second spring loaded check valve means mounted in the bore in spaced relation to open in opposite directions, said first spring loaded check valve means being operational in expansion of said expandable seal means and said second spring loaded check valve means being operational to maintain said seal means thereafter in expanded position;

f. said housing having first port means for selective fluid communication between the longitudinal bore between said first and second check valve means and the exterior of said housing; and g. there being second port means in said housing normally closing off from said first port means by said first spring loaded check valve means, a second port means being communicable with the first port means when the pressure in the longitudinal bore overcomes said spring loaded check valve means, for expansion of said expandable seal means.

6. The invention of claim 5 including:

a. third port means in said housing normally closed off from communicating with the first port means by said spring loaded check valve means;

b. plug means in the third port means closing off communication between the longitudinal bore and the space; and c. shear means retaining said plug means in the third port means, said shear means releasing said plug means when the pressure in the longitudinal bore reaches a predetermined amount to communicate the longitudinal bore with the space.

7. The invention of claim 6 wherein said first spring loaded check valve means closes when the third port means communicates the longitudinal bore with the space to trap fluid in said expandable seal means.

* * * * *